US010016803B2

(12) United States Patent
Kobs et al.

(10) Patent No.: US 10,016,803 B2
(45) Date of Patent: Jul. 10, 2018

(54) BLANKING DIE AND METHOD OF BLANKING SHEET METAL THEREWITH

(71) Applicant: Honda Motor Co., Ltd., Minato-ku, Tokyo (JP)

(72) Inventors: Steven Kobs, Marysville, OH (US); John Woods, Springfield, OH (US); Corey Cleman, Marysville, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 479 days.

(21) Appl. No.: 14/273,831

(22) Filed: May 9, 2014

(65) Prior Publication Data

US 2015/0321241 A1 Nov. 12, 2015

(51) Int. Cl.

*B21D 45/02* (2006.01)
*B21D 45/00* (2006.01)
*B21D 28/06* (2006.01)

(52) U.S. Cl.

CPC ..... *B21D 45/02* (2013.01); *B21D 28/06* (2013.01); *B21D 45/003* (2013.01); *Y10T 83/0448* (2015.04); *Y10T 83/2122* (2015.04)

(58) Field of Classification Search

CPC . Y10T 83/0529; Y10T 83/0534; Y10T 83/06; Y10T 83/4513; B21D 45/00; B21D 45/02; B21D 45/003; B21D 28/00; B21D 28/06

USPC ..... 83/40, 41, 55, 92, 92.1; 76/101.1; 198/369.1, 369.6, 370.06, 371.2

See application file for complete search history.

(56) References Cited

U.S. PATENT DOCUMENTS 2,849,064 A 8/1958 Stanley
3,455,197 A * 7/1969 Richardson ..... B26D 1/04 83/468.3
3,589,221 A * 6/1971 Deegan ..... B23D 31/008 83/41
4,068,520 A * 1/1978 Carrieri ..... B21D 45/04 100/218
4,075,963 A * 2/1978 Crago ..... B21D 45/02 198/728
4,370,878 A * 2/1983 Carrieri ..... B21J 13/14 72/345
4,730,762 A * 3/1988 Felix ..... B65H 35/10 225/100
4,956,008 A * 9/1990 McQuilkin ..... B21D 26/055 164/344
5,176,613 A * 1/1993 Cavlin ..... B26D 3/085 493/354
5,235,881 A * 8/1993 Sano ..... B21D 28/16 72/333
5,353,669 A * 10/1994 Booth ..... B23D 15/005 83/132
5,429,223 A * 7/1995 Moeller ..... B65G 47/647 198/369.1

(Continued)

*Primary Examiner* — Jason Daniel Prone
*Assistant Examiner* — Richard Crosby, Jr.
(74) *Attorney, Agent, or Firm* — Arent Fox LLP

(57) ABSTRACT

An example of a blanking die includes a blanking apparatus configured to form a series of at least two metallic blanks from sheet metal, and an ejection apparatus configured to eject a first one of the series of the metallic blanks out of the blanking die in a predetermined direction and a second one of the series of the metallic blanks out of the blanking die in said predetermined direction.

12 Claims, 6 Drawing Sheets

(56) References Cited

U.S. PATENT DOCUMENTS 5,564,264 A * 10/1996 DeCrane ..... B65G 47/54 198/369.6
5,839,337 A * 11/1998 Neu ..... B23D 45/10 83/255
5,984,078 A * 11/1999 Bonnet ..... B65G 47/53 198/349.6
6,182,547 B1 * 2/2001 Bond ..... B21D 43/12 198/679
6,427,512 B2 * 8/2002 Suzuki ..... B21D 53/14 72/327
6,565,349 B1 * 5/2003 Tanaka ..... B21D 28/14 264/157
6,688,201 B1 * 2/2004 Dokyu ..... B21D 28/06 83/206
7,021,099 B2 * 4/2006 Bennett ..... B21D 45/02 72/344
8,881,570 B2 * 11/2014 Hansen ..... B21D 45/02 72/344
2004/0046012 A1 * 3/2004 Song ..... B21D 37/205 234/1
2005/0103171 A1 * 5/2005 Bradbury ..... B23D 25/10 83/13
2012/0255410 A1 * 10/2012 Kido ..... B21D 53/022 83/202
2013/0000458 A1 * 1/2013 Ueda ..... B26D 7/018 83/367
2013/0019732 A1 * 1/2013 Yotsumoto ..... B26F 1/40 83/331
2013/0047807 A1 * 2/2013 Sotokawa ..... B26F 1/14 83/55
2013/0091997 A1 * 4/2013 Tang ..... B21D 28/265 83/109
2013/0186245 A1 * 7/2013 Onishi ..... B21D 28/002 83/55
2014/0260851 A1 * 9/2014 Beaudry ..... B26D 7/2614 83/56
2014/0318340 A1 * 10/2014 Mochizuki ..... B26D 5/32 83/346

* cited by examiner

BLANKING DIE AND METHOD OF BLANKING SHEET METAL THEREWITH

BACKGROUND

A blanking die is used in a stamping department of an automobile plant to cut sheet metal into a shaped or rectangular metallic blank that can be fed into a stamping press for fabrication of a stamped part from the fed metallic blank. The blanking die may be implemented in a manufacturing process, where a portion of a coil of sheet metal is fed to the blanking die. In an example of this process, a blanking press is provided above the blanking die and serves to press the sheet metal fed to the blanking die onto cutters on a surface of the blanking die, thereby cutting a blank from the coil of sheet metal. The blanking press is then moved upward, thereby allowing the newly formed blank to be ejected by the blanking die to be used in another portion of the manufacturing process. The ejection of the blank enables another portion of the coil of sheet metal to be fed to the blanking die for blanking. The blanking operation of this example is designed to be repeated to produce numerous blanks quickly.

In certain situations, it may be desired to form two blanks with one down-stroke of the blanking press. To support such a process, a blanking die can be designed to output two blanks for every down-stroke of the blanking press. In an example of such a blanking die, a front blank on the blanking die is ejected out of a front portion of the blanking die, whereas a rear blank, which is positioned behind the front blank on the blanking die, is ejected out of a side portion of the blanking die to be conveyed to a stacker using a set of rollers.

However, the rear blank may be scratched when it is ejected from the blanking die in directions other than a direction associated with the ejection of the rear blank out of the side portion of the blanking die. In addition, in the example provided above, the front blank is typically ejected across the die to an exit conveyor by a set of magnetic rollers. However, magnetic rollers are only effective in conveying blanks in applications where the sheet metal fed to the blanking die is a certain type of metal that can be magnetized, such as iron, cobalt, and types of steel containing particular amounts of iron. Thus, magnetic rollers are unable to be used with metals lacking a requisite amount of iron contained therein, such as, but not limited to, aluminum and certain types of stainless steel.

APPLICATION SUMMARY

In an embodiment, a blanking die includes a blanking apparatus configured to form a series of at least two metallic blanks from sheet metal, and an ejection apparatus configured to eject a first one of the series of the metallic blanks out of the blanking die in a predetermined direction and a second one of the series of the metallic blanks out of the blanking die in the predetermined direction.

In another embodiment, a method of blanking sheet metal with a blanking die includes the steps of forming a series of at least two metallic blanks from the sheet metal using the blanking die, ejecting a first one of the series of the metallic blanks out of the blanking die in a predetermined direction, and ejecting a second one of the series of the metallic blanks out of the blanking die in the predetermined direction.

In a further embodiment, a blanking die includes a blanking apparatus configured to form, from sheet metal, a series of at least two metallic blanks, an ejection apparatus configured to eject a first one of the metallic blanks out of the blanking die in a predetermined direction and a second one of the metallic blanks out of the blanking die in the predetermined direction, and a pneumatic system configured to raise an ejecting mechanism from a storage position to an ejection position when the ejecting mechanism is needed to eject the second one of the metallic blanks to a front ejector and lower the ejecting mechanism from the ejection position to the storage position when the ejecting mechanism has ejected the second one of the metallic blanks to the front ejector. The ejection apparatus includes the front ejector and the rear ejector. The front ejector is configured to eject the first one of the metallic blanks out of the blanking die. The rear ejector includes an ejecting mechanism and a cavity. The ejecting mechanism is configured to eject the second one of the metallic blanks in the predetermined direction to the front ejector while the first one of the metallic blanks is being ejected by the front ejector. The front ejector is further configured to eject the second one of the metallic blanks ejected by the ejecting mechanism out of the blanking die in the predetermined direction. The cavity is configured to store the ejecting mechanism in the storage position within the cavity until the ejecting mechanism is needed in the ejection position above the cavity to eject the second one of the metallic blanks to the front ejector.

Other features and aspects may be apparent from the following detailed description, the drawings, and the claims.

Figure 1:
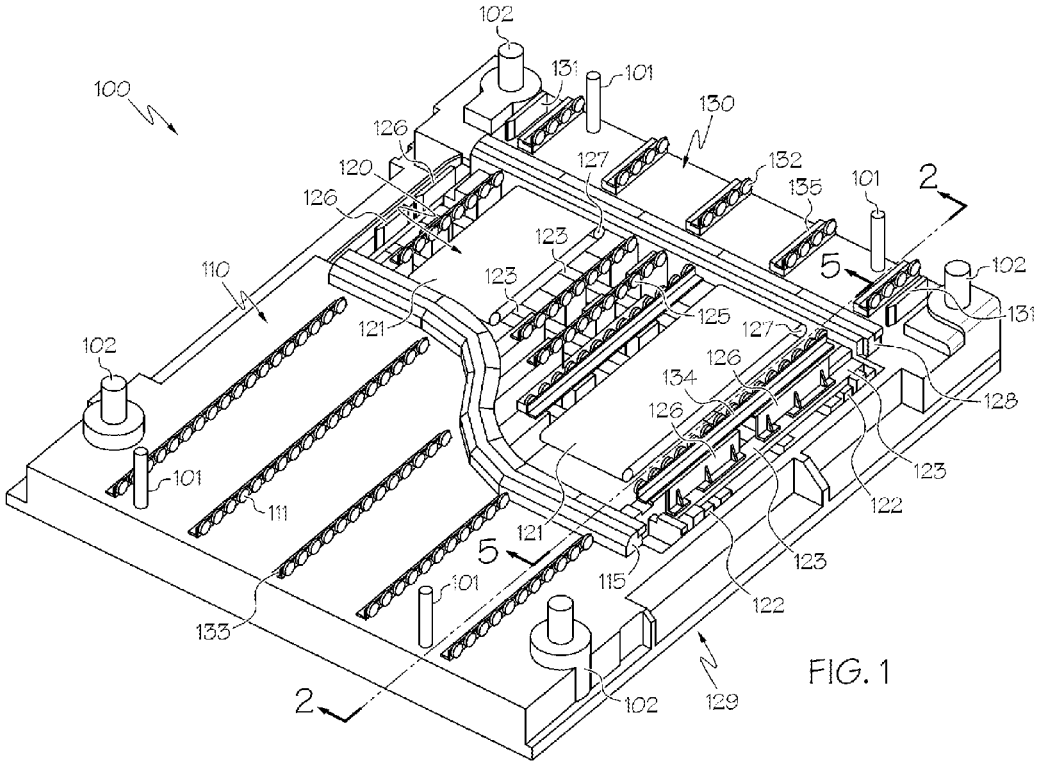
FIG. 1 is a perspective view illustrating an example of a blanking die according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more embodiments are described and illustrated in the drawings. These illustrated examples are not intended to be limiting. For example, one or more aspects of an embodiment may be utilized in other embodiments and even other types of devices.

Figure 2:
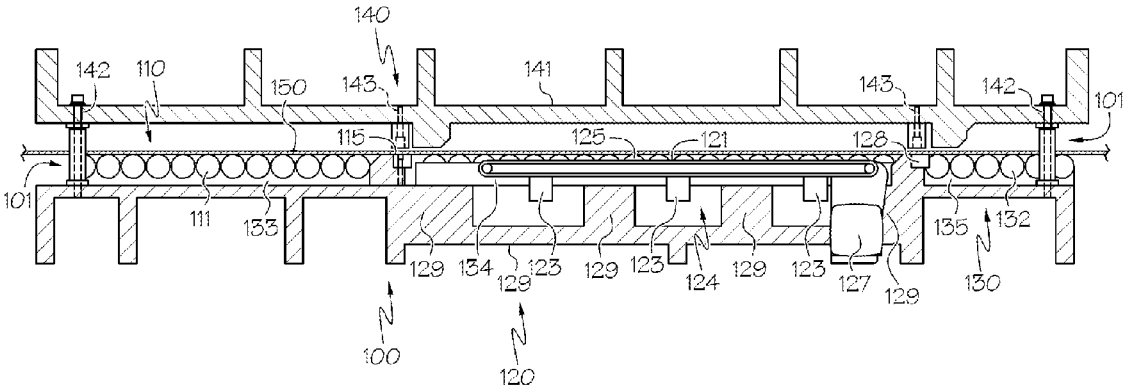
FIG. 2 is a sectional view illustrating an example of the blanking die taken along 2-2 in FIG. 1 when a blanking press is in a pressing position.
Figure 3:
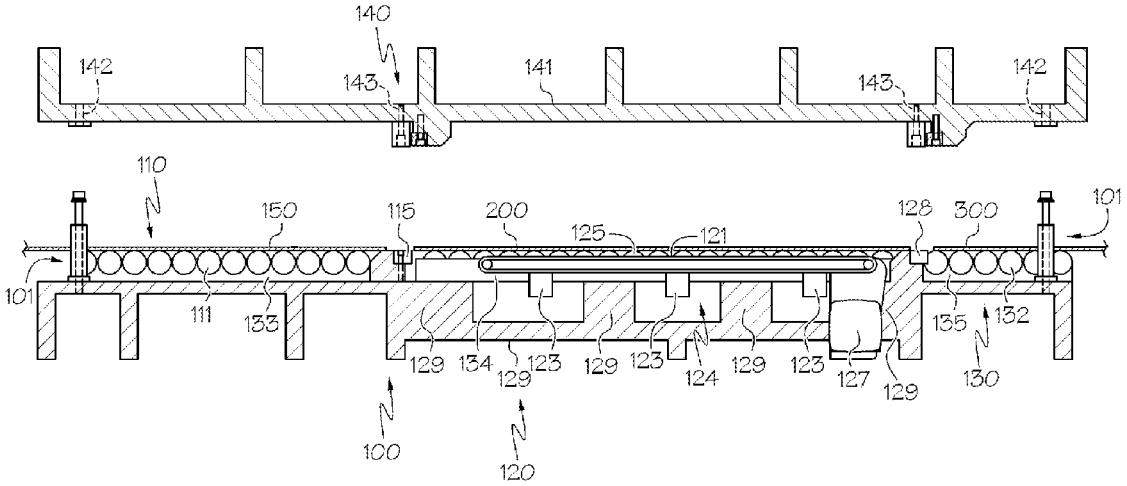
FIG. 3 is a sectional view illustrating an example of the blanking die taken along 2-2 in FIG. 1 when a blanking press is in a raised position and a rear ejector is in a storage position.
Figure 4:
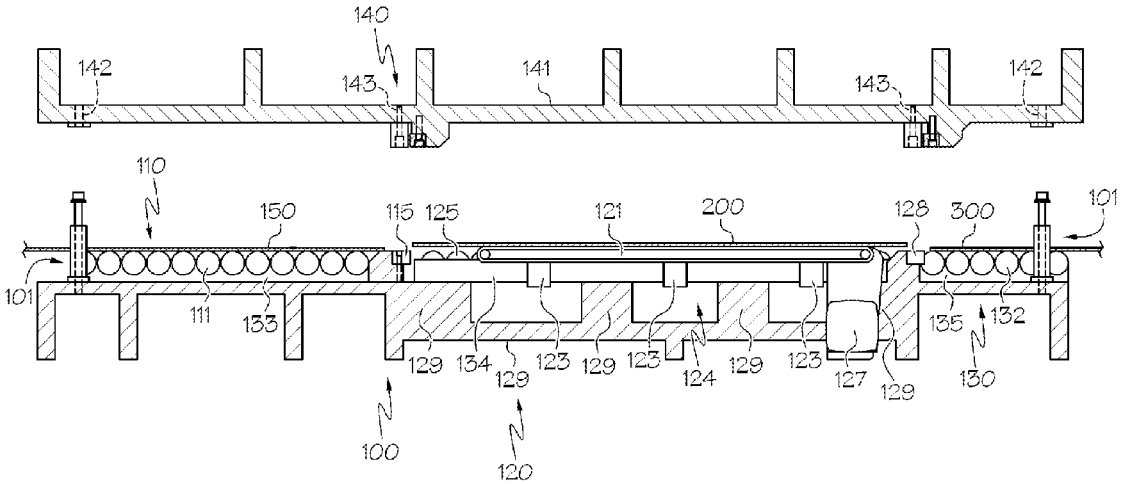
FIG. 4 is a sectional view illustrating an example of the blanking die taken along 2-2 in FIG. 1 when a blanking press is in a raised position and a rear ejector is in an ejection position.
Figure 5:
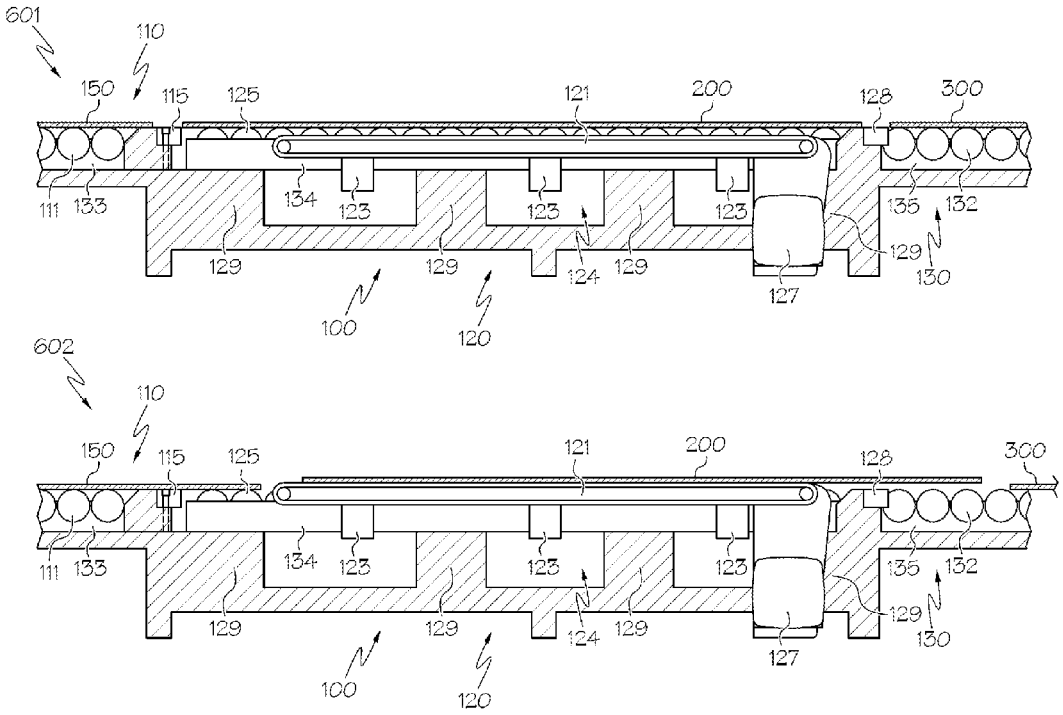
FIG. 5 is a set of sectional views illustrating an example of the blanking die taken along 5-5 of FIG. 1 during operation stages according to an embodiment.
Figure 6:
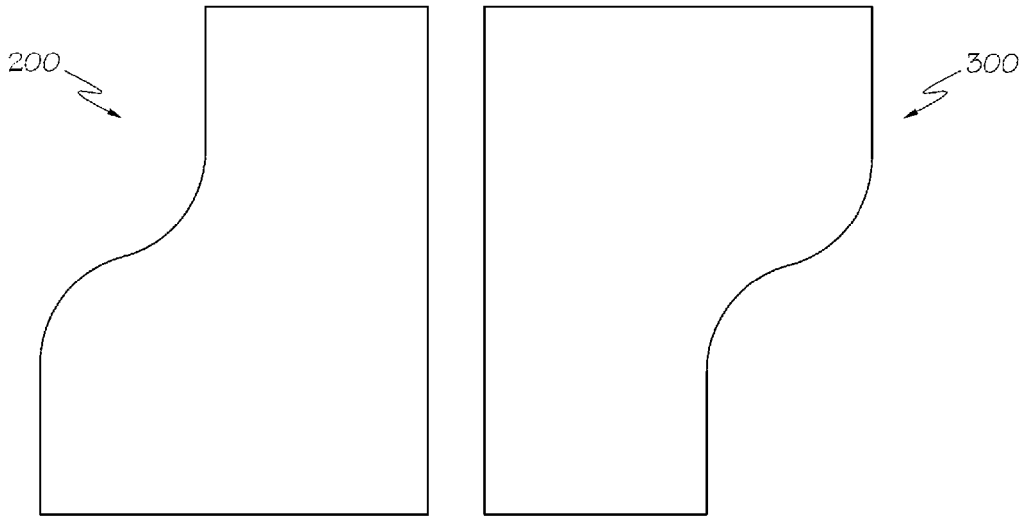
FIG. 6 is a top view illustrating an example of blanks machined from sheet metal by the example embodiments of the blanking die illustrated in FIGS. 1-5.

FIG. 1 is a perspective view illustrating an example of a blanking die 100. FIGS. 2-4 are sectional views illustrating examples of the blanking die 100 taken along 2-2 in FIG. 1 with a blanking press 140 and a rear ejector 120 being displayed in various configurations. FIG. 5 is a set of sectional views illustrating an example 600 of the blanking die 100 taken along 5-5 of FIG. 1 during operation stages 601, 602. FIG. 6 is a top view illustrating an example of blanks 200, 300 machined from sheet metal 150 by the example blanking die 100 illustrated in FIGS. 1-5.

An example blanking die 100 as illustrated in FIGS. 1-5 includes a die frame 129, a feeding mechanism 110, a rear blank cutter 115, a rear ejector 120, a rear ejector frame 123, a pneumatic system 122, a front blank cutter 128, and a front ejector 130. However, embodiments disclosed herein are not limited thereto. In an example, additional blank cutters and ejectors are included with the rear blank cutter 115, the rear ejector 120, the front blank cutter 128, and the front ejector 130 of the example blanking die 100 to provide a corresponding number of desired blanks. Further, in an example, the rear ejector 120 and the front ejector 130 are defined to be an example ejection apparatus.

Shown in the example blanking die 100 illustrated in FIGS. 1-5, the die frame 129 is an underlying structural frame for the blanking die 100 that provides support for several components of the blanking die 100. The die frame 129 provides support for press bolts 101 and press guides 102 placed in various locations in the feeding mechanism 110 and the front ejector 130. In addition, the die frame 129 provides support for feeding roller frames 133, rear roller frames 134, and front roller frames 135 placed respectively in the feeding mechanism 110, the rear ejector 120, and the front ejector 130 to respectively support feeding rollers 111, rear rollers 125, and front rollers 132. Further, the die frame 129 provides support for the rear blank cutter 115 between the feeding mechanism 110 and the rear ejector 120 and the front blank cutter 128 between the rear ejector 120 and the front ejector 130. In addition, the die frame 129 provides support for front ejector guides 131 and rear ejector guides 126.

In the example blanking die 100 illustrated in FIGS. 1-5, the rear blank cutter 115 and the front blank cutter 128 are defined to be an example blanking apparatus and positioned to cut supplied sheet metal 150 into a second metallic blank 200 and a first metallic blank 300. The second metallic blank 200 and the first metallic blank 300 are oriented in series, with the first metallic blank 300 being positioned to be ejected before the second metallic blank 200. The front ejector 130 is positioned to eject the first metallic blank 300 in a predetermined direction. An ejecting mechanism 121 of the rear ejector 120 is positioned to eject the second metallic blank 200 in the same predetermined direction in which the first metallic blank 300 is ejected. The front ejector 130 is positioned to eject the second metallic blank 200 after the second metallic blank 200 is ejected by the ejecting mechanism 121 of the rear ejector 120 to the front ejector 130. In an example, the cutters 115, 128 are made of any material known to one having ordinary skill in the art for cutting sheet metal, including, but not limited to, low-alloy steel and/or high-carbon steel.

In the example illustrated in FIGS. 2-4, a blanking press 140 presses the sheet metal 150 onto the blank cutters 115, 128 to cut the sheet metal into the metallic blanks 200, 300. The blanking press 140 includes pressing implements 143 that press the sheet metal 150 onto the blank cutters 115, 128 to form the metallic blanks 200, 300. The blanking die 100 includes the press guides 102 positioned on the die frame 129 in various locations adjacent to or on the feeding mechanism 110 and the front ejector 130 designed to support proper alignment of the blanking press 140 with the blanking die 100. The press bolts 101 positioned on the die frame 129 in various locations adjacent to or on the feeding mechanism 110 and the front ejector 130 fit through press receptacles 142 of the blanking press 140 to secure the blanking press 140 to the blanking die 100 during the pressing of the sheet metal 150.

In the example illustrated in FIG. 2, the blanking press 140 is in a pressing position in which the pressing implements 143 press the sheet metal 150 onto the blank cutters 115, 128 to form the metallic blanks 200, 300. In the example illustrated in FIGS. 3 and 4, the blanking press 140 is in a raised position to allow the metallic blanks 200, 300 to be respectively ejected from the ejecting mechanism 121 of the rear ejector 120 and the front ejector 130.

The front ejector 130 and the ejecting mechanism 121 of the rear ejector 120 eject blanks that are either capable or not capable of being magnetized. As such, the front ejector 130 and the ejecting mechanism of the rear ejector 120 can be designed to either have magnetic properties or operate without magnetic properties, as desired. In addition, the front ejector 130 can be designed to have magnetic properties, and the ejecting mechanism 121 of the rear ejector 120 can be designed without having magnetic properties, or vice versa.

Further, while example sheet metal 150 described herein is aluminum and provided to the blanking die 100 from a metal coil (not shown), embodiments herein are not limited thereto. In an example, portions of sheet metal are individually fed into the blanking die 100. In an additional example, magnetic sheet metal, such as, but not limited to, iron, cobalt, and/or types of steel containing particular amounts of iron, is fed to the blanking die 100 for blanking. In another example, in addition to aluminum, other metals lacking a requisite amount of magnetic material contained therein to be magnetic, such as, but not limited to, magnesium, titanium, copper, and certain types of stainless steel, are fed to the blanking die 100. As a result, the blanking die 100 is configured for use with magnetic sheet metal and/or non-magnetic sheet metal, as desired.

Moreover, while the front ejector 130 and the ejecting mechanism 121 of the rear ejector 120 of the blanking die 100 are described herein to respectively eject the first metallic blank 300 and the second metallic blank 200 in a predetermined direction, embodiments disclosed herein are not limited thereto. For example, the blanking die 100 can be configured to support a variety of ejectors that eject blanks in different directions. In another example, the blanking die 100 can be configured to support one or more ejectors that eject certain blanks in a particular direction and one or more other ejectors that allow other blanks to drop below the blanking die 100 to be routed in another direction, for example. Other embodiments could be configured to eject the blanks in still different directions, or combinations thereof.

Additionally, while the front ejector 130 is described herein to eject the second metallic blank 200 ejected by the ejecting mechanism 121 of the rear ejector 120 in the same predetermined direction in which the first metallic blank 300 was ejected, embodiments disclosed herein are not limited thereto. For example, the front ejector 130 can be designed to receive the ejected second metallic blank 200 from the ejecting mechanism 121 of the rear ejector 120 and eject the second metallic blank 200 in a different direction from the direction in which the first metallic blank 300 was ejected. In another example, the front ejector 130 can eject the first metallic blank 300 in the predetermined direction before the ejecting mechanism 121 of the rear ejector 120 ejects the second metallic blank 200 to the front ejector 130 in the predetermined direction. Other embodiments could be configured to eject the first and second blanks in any number different directions, as desired.

Also, while the example blanking die 100 illustrated in FIG. 1 shows the front blank cutter 128 being straight across the blanking die 100 and the rear blank cutter 115 having an S-shape across the blanking die 100, thereby providing first metallic blanks 300 and second metallic blanks 200 having one side that is S-shaped and an opposite side that is straight, as in the example blanks 200, 300 illustrated in FIG. 6, embodiments disclosed herein are not limited thereto. For example, the front blank cutter 128 can have an S-shape while the rear blank cutter 115 is straight. In another example, the front blank cutter 128 and the rear blank cutter 115 can both be straight. In a further example, the front blank cutter 128 and the rear blank cutter 115 can both be formed into various shapes across the blanking die 100 to affect any desired profile of the first metallic blank 300 and the second metallic blank 200.

In the example blanking die 100 illustrated in FIGS. 1-5, the front ejector 130 includes front ejector guides 131 and the rear ejector 120 includes rear ejector guides 126 that operate in synchronization with the ejecting mechanism 121 of the rear ejector 120. The front ejector guides 131 are positioned at opposite outer portions of the front ejector 130 adjacent to the front rollers 132. The rear ejector guides 126 are positioned at opposite outer portions of the rear ejector 120.

In an example, the front ejector guides 131 on opposite outer portions of the front ejector 130 are spaced a distance apart from each other that is substantially equivalent to a length of the front blank cutter 128. In another example, the front ejector guides 131 on opposite outer portions of the front ejector 130 are spaced a distance apart from each other that is just greater than a width of the sheet metal being blanked by the blanking die 100. In a further example, the front ejector guides 131 on opposite outer portions of the front ejector 130 promote a proper alignment of the sheet metal 150 prior to the blanking of the sheet metal 150. In an additional example, the front ejector guides 131 on opposite outer portions of the front ejector 130 promote blank ejections in a predetermined direction. In still another example, the front ejector guides 131 on opposite outer portions of the front ejector 130 take the form of walls.

In an example, the rear ejector guides 126 on opposite outer portions of the rear ejector 120 are spaced a distance apart from each other that is substantially equivalent to a length of the front blank cutter 128. In another example, the rear ejector guides 126 on opposite outer portions of the rear ejector 120 are spaced a distance apart from each other that is just greater than a width of the sheet metal 150 being blanked by the blanking die 100. In a further example, the rear ejector guides 126 on opposite outer portions of the rear ejector 120 promote a proper alignment of the sheet metal 150 prior to the blanking of the sheet metal 150. In an additional example, the rear ejector guides 126 on opposite outer portions of the rear ejector 120 assist guiding of blank ejections by the ejecting mechanism 121 of the rear ejector 120 in a predetermined direction. In still another example, the rear ejector guides 126 on opposite outer portions of the rear ejector 120 take the form of walls.

In the example blanking die 100 illustrated in FIGS. 1-5, the front ejector 130 includes the front rollers 132 supported by the front roller frames 135. The front rollers 132 eject from the blanking die 100 the first metallic blank 300 from the front ejector 130 and the second metallic blank 200 conveyed to the front rollers 132 by the ejecting mechanism 121 of the rear ejector 120. The front rollers 132 and the front roller frames 135 are positioned in rows along planes that are perpendicular to the front blank cutter 128. The front rollers 132 are mounted on the front roller frames 135 to spin clockwise from the back to the front of the blanking die 100 in order to eject the first metallic blank 300 and the second metallic blank 200. However, embodiments described herein are not limited thereto. In one example, the front rollers 132 can be positioned on the die frame 129 in columns parallel to the front blank cutter 128. In another example, the front roller frames 135 can provide support for the front rollers 132 in columns parallel to the front blank cutter 128. In a further example, the front roller frames 135 can be mounted on the die frame 129 to allow the front rollers 132 to spin counterclockwise from the back to the front of the blanking die 100.

In the example blanking die 100 illustrated in FIGS. 1-5, the rear ejector 120 includes the rear rollers 125 supported by the rear roller frames 134. The rear rollers 125 define a staging mechanism by which support is provided for the second metallic blank 200 after the second metallic blank 200 is cut by the front blank cutter 128 and the rear blank cutter 115 and prior to the ejection of the second metallic blank 200 by the ejecting mechanism 121 of the rear ejector 120 to the front ejector 130. The rear rollers 125 and the rear roller frames 134 are positioned in rows along planes that are perpendicular to the front blank cutter 128. The rear rollers 125 are mounted on the rear roller frames 134 to spin clockwise or counterclockwise from the back to the front of the blanking die 100. The rear rollers 125 allow a second metallic blank 200 to rest thereon after a formation thereof.

In the example illustrated in FIGS. 1-5, the blanking die 100 includes the feeding mechanism 110 positioned behind the rear blank cutter 115. The feeding mechanism 110 includes feeding rollers 111 positioned in rows between the press guides 102 and supported by feeding roller frames 133. In an example, the feeding rollers 111 feed sheet metal 150 to the blank cutters 115, 128 for blanking.

The feeding rollers 111 and the feeding roller frames 133 are positioned in rows along planes that are perpendicular to the front blank cutter 128. The feeding rollers 111 are mounted on the feeding roller frames 133 to spin clockwise from the back to the front of the blanking die 100. However, embodiments described herein are not limited thereto. In an example, the feeding rollers 111 can be positioned on the die frame 129 in columns parallel to the front blank cutter 128. In another example, the feeding roller frames 133 can provide support for the feeding rollers 111 in columns parallel to the front blank cutter 128. In a further example, the feeding roller frames 133 can be mounted on the die frame 129 to allow the feeding rollers 111 to spin counterclockwise from the back to the front of the blanking die 100.

In the example blanking die 100 illustrated in FIGS. 1-5, the ejecting mechanism 121 of the rear ejector 120 is defined by at least one conveyor belt resting on a rear ejector frame 123. The ejecting mechanism 121 of the rear ejector 120 is operated to eject the second metallic blank 200 in the predetermined direction, thereby ejecting the second metallic blank 200 to the front ejector 130 for subsequent ejection by the front rollers 132 in the predetermined direction from the blanking die 100. When the ejecting mechanism 121 of the rear ejector 120 is defined by at least one conveyor belt, the ejecting mechanism 121 of the rear ejector 120 is spun to eject the second metallic blank 200 in the predetermined direction. While the example blanking die 100 illustrated in FIG. 1 defines the ejecting mechanism 121 of the rear ejector 120 as multiple conveyor belts, embodiments described herein are not limited thereto. In an example, the ejecting mechanism 121 is defined by only one large conveyor belt. In another example, the ejecting mechanism 121 of the rear ejector 120 can be defined by multiple rollers to eject the second metallic blank 200.

According to the example blanking die 100 illustrated in FIGS. 1-5, the rear ejector frame 123 provides movable support for the ejecting mechanism 121 of the rear ejector 120. In an example, the rear ejector frame 123 is constructed of any rigid material known by one having ordinary skill in the art to be able to movably support the ejecting mechanism 121 of the rear ejector 120, including, but not limited to, metal or injection molded plastic.

According to the example blanking die 100 illustrated in FIGS. 1-5, a cavity 124 is provided between the blank cutters 115, 128 in the rear ejector 120. The ejecting mechanism 121 of the rear ejector 120 has a storage position in the cavity 124 in which the ejecting mechanism 121 of the rear ejector 120 is positioned when not ejecting the second metallic blank 300 and until it is needed to eject the second metallic blank 200 to the front ejector 130. In an example, when the ejecting mechanism 121 is needed to eject the second metallic blank 200 to the front ejector 130, the rear ejector frame 123 raises the ejecting mechanism 121 from a storage position in the cavity 124 in which the ejecting mechanism 121 is stored to an ejection position above the cavity 124. In another example, when the ejecting mechanism 121 has ejected the second metallic blank 200 to the front ejector 130, the rear ejector frame 123 lowers the ejecting mechanism 121 from the ejection position to the storage position.

According to the example blanking die 100 illustrated in FIGS. 3-5, a front edge of the first metallic blank 300 is cut by the rear blank cutter 115 prior to being blanked by the front blank cutter 128. Stage 601 of FIG. 5 is a cutting stage illustrating an example blanking die 100 after the rear blank cutter 115 has cut the sheet metal 150 to separate the second metallic blank 200 from the sheet metal 150 located behind the rear blank cutter 115 that has not been cut by the front blank cutter 128. Cutting stage 601 of FIG. 5 additionally illustrates an example blanking die 100 after a front edge of a future first metallic blank 300 that is the subject of a subsequent ejection has been created and is located behind the rear blank cutter 115. Cutting stage 601 of FIG. 5 can show a static example of the blanking die 100 consistent with a step of forming blanks during a method of blanking sheet metal using the blanking die 100.

In the example blanking die 100 illustrated in cutting stage 601 of FIG. 5, the ejecting mechanism 121 is positioned in the storage position within the cavity 124. Further, in the example blanking die 100 illustrated in cutting stage 601 of FIG. 5, the feeding rollers 111 are illustrated as allowing the future first metallic blank 300 that is the subject of a subsequent ejection, which is still attached to uncut sheet metal 150 and presently located behind the rear blank cutter 115, to rest thereon.

After the first metallic blank 300 is ejected by the front ejector 130 in the predetermined direction and the second metallic blank 200 is ejected by the ejecting mechanism 121 of the rear ejector 120 to the front ejector 130 for ejection in the predetermined direction, the future first metallic blank 300 located behind the rear blank cutter 115 and resting on the feeding rollers 111 is fed forward by the feeding rollers 111 in front of the front blank cutter 128 to be cut by the front blank cutter 128 to complete the blanking of the first metallic blank 300. A portion of uncut sheet metal 150 attached to the future first metallic blank 300 is fed forward by the feeding rollers 111 and positioned between the front blank cutter 128 and the rear blank cutter 115. At the same time that the first metallic blank 300 is blanked by the front blank cutter 128, the second metallic blank 200 is blanked by the simultaneous cutting of the front blank cutter 128 and the rear blank cutter 115.

In another example, the rear blank cutter 115 cuts an edge of the second metallic blank 200 before the front blank cutter 128 separates the second metallic blank 200 from the first metallic blank 300. In a further example, the front blank cutter 115 creates an edge of the second metallic blank 200 while simultaneously blanking the first metallic blank 300 prior to the blanking of the second metallic blank 200 by separating the second metallic blank from 200 from the sheet metal 150. In such examples, the blanking press 140 includes multiple presses configured to press the sheet metal 150 onto the rear blank cutter 115 at a different time than the sheet metal 150 is pressed onto the front blank cutter 115.

Stage 602 of FIG. 5 is an ejection stage illustrating an example blanking die 100 when the first metallic blank 300 is being ejected by the front ejector 130, the second metallic blank 200 is being ejected by the rear ejector 120 with the ejecting mechanism 121 positioned in the ejection position above the cavity 124, and the sheet metal 150 having a front edge representing a form of a future first metallic blank 300 is being fed by the feeding mechanism 110. According to the example blanking die 100 illustrated in ejecting stage 602 of FIG. 5, the first metallic blank 300 has been ejected by the front rollers 132 of the front ejector 130 in the predetermined direction after the creation of the first metallic blank 300 by the front blank cutter 128. The predetermined direction, according to the example blanking die 100 illustrated in ejecting stage 602 of FIG. 5, is a direction perpendicular to a width of the blanking die 100 and away from the feeding mechanism 110 and the rear ejector 120 of the blanking die 100. Ejecting stage 602 of FIG. 5 can show a static example of the blanking die 100 consistent with a step of ejecting metallic blanks during a method of blanking sheet metal using the blanking die 100.

According to the example blanking die 100 illustrated in FIGS. 1-5, the pneumatic system 122 is designed to move the rear ejector frame 123 from one position to another. For example, as is illustrated in the example blanking die 100 of FIG. 4 and ejecting stage 602 of FIG. 5, after a second metallic blank 200 has been cut, the pneumatic system 122 can raise the rear ejector frame 123 to move the ejecting mechanism 121 of the rear ejector 120 from the storage position to an ejection position above the cavity 124. In an example, the rear ejector guides 126 are mounted on the rear ejector frame 123 such that they move with the movement of the ejecting mechanism 121 of the rear ejector 120 and the rear ejector frame 123 to guide an ejection of the second metallic blank 200 in the predetermined direction. The ejection position is a position above the front blank cutter 128 and the rear rollers 125 in which the ejecting mechanism 121 of the rear ejector 120 can eject the second metallic blank 200 to the front ejector 130 in the predetermined direction.

After the ejecting mechanism 121 of the rear ejector 120 ejects the second metallic blank 200 to the front ejector 130, the pneumatic system 122 lowers the rear ejector frame 123 to move the ejecting mechanism 121 of the rear ejector 120 from the ejection position above the cavity 124 to the storage position within the cavity 124 until a subsequent second metallic blank 200 is in need of ejection to the front ejector 130.

In an example approach, the pneumatic system 122 is defined by at least one air cylinder that extends to raise the rear ejector frame 123 and contracts to lower the rear ejector frame 123. However, the pneumatic system 122 is not limited thereto. In an example, the pneumatic system 122 is defined by any pneumatic implementation or mechanism known by one having ordinary skill in the art to be appropriate in the raising and lowering of structures such as the rear ejector frame 123. Further, the movement mechanism of the rear ejector frame 123 is not limited to the pneumatic system 123 as shown. In an example, the movement mechanism includes any mechanism known by one having ordinary skill in the art to be appropriate in the raising and lowering of structures such as the rear ejector frame 123. In an example, a hydraulic or electric system is used in place of the pneumatic system 122.

According to the example blanking die 100 illustrated in FIGS. 2-5, the rear rollers 125 allow the second metallic blank 200, after the formation thereof, to rest on the rear rollers 125 over the storage position and cavity 124 of the rear ejector 120, below the ejection position of the ejecting mechanism 121 of the rear ejector 120, and between the front blank cutter 128 and the rear blank cutter 115. When the rear ejector frame 123 is raised, the ejecting mechanism 121 of the rear ejector 120 moves from the storage position to the ejection position, thereby moving the second metallic blank 200 that is resting on the rear rollers 125 to the ejection position above the rear rollers 125 and the front blank cutter 128 to be ejected.

In the example blanking die 100 illustrated in FIG. 4 and ejecting stage 602 of FIG. 5, the ejecting mechanism 121 of the rear ejector 120 is operated to eject the second metallic blank 200 when the ejecting mechanism 121 of the rear ejector 120 is in the ejection position. Further, in an example, the ejecting mechanism 121 of the rear ejector 120 is defined by at least one conveyor belt that eject the second metallic blank 200 when positioned in the ejection position. In an example, the conveyor belt representing the ejecting mechanism 121 of the rear ejector 120 is spun to eject the second metallic blank 200 when the conveyor belt representing the ejecting mechanism 121 of the rear ejector 120 is in the ejection position. In the example blanking die 100 illustrated in FIG. 1, multiple conveyor belts are part of the ejecting mechanism 121.

In the example blanking die 100 illustrated in ejecting stage 602 of FIG. 5, the ejection of the first metallic blank 300 from the front ejector 130, the ejection of the second metallic blank 200 from the ejection position the ejecting mechanism 121 of the rear ejector 120, and the feeding of additional sheet metal 150 to the front ejector 130 and the rear ejector 120 occurs simultaneously. In the example blanking die 100 illustrated in ejecting stage 602 of FIG. 5, the blanks 200, 300 have been or are in the process of being formed. Further, the ejecting mechanism 121 of the rear ejector 120 has been raised from the storage position to the ejection position, thereby lifting the second metallic blank 200 off the rear rollers 125. In this example, when the ejecting mechanism 121 of the rear ejector 120 is raised into the ejection position while the second metallic blank 200 is resting thereon, the ejecting of the front ejector 130, the ejecting of the ejecting mechanism 121 of the rear ejector 120, and the feeding of the additional sheet metal 150 to the ejectors 120, 130 occurs simultaneously.

However, embodiments described herein are not limited thereto. In another example, the ejecting mechanism 121 of the rear ejector 120 is operating when it begins to lift the second metallic blank 200 from the resting position on the rear rollers 125. In this example, the lifting of the second metallic blank 200 by the ejecting mechanism 121 of the rear ejector 120 is timed such that ejection of the second metallic blank 200 occurs when the second metallic blank 200 is able to clear the front blank cutter 128 when ejected from the ejecting mechanism 121 of the rear ejector 120 to the front ejector 130. In this example, the ejection of the first metallic blank 300 from the front ejector 130 begins prior to the ejecting mechanism 121 of the second ejector 120 being fully in the ejection position, so that the front ejector 130 is able to accommodate the second metallic blank 200 being ejected from the ejecting mechanism 121 of the rear ejector 120. The ejecting mechanism 121 of the rear ejector 120 continues elevation into the ejection position while it is ejecting the second metallic blank 200 to the front ejector 130.

Further, in an example, the feeding of the additional sheet metal 150 to the ejectors 120, 130 is timed such that the additional sheet metal 150 is supported by a portion of the rear rollers 125 positioned adjacent to the rear blank cutter 115 while being fed and is not fed further onto the rear ejector 120 until the ejecting mechanism 121 of the rear ejector 120 is underneath all of the rear rollers 125.

In an example, when the second metallic blank 200 is ejected, as the pneumatic system 122 lowers the rear ejector frame 123 to move the ejecting mechanism 121 of the rear ejector 120 from the ejection position to the storage position, the operation of the ejecting mechanism 121 of the rear ejector 120 is ceased. However, embodiments disclosed herein are not limited thereto. In an example, the ejecting mechanism 121 of the rear ejector 120 is continuously operated. Further, in another example, conveyor belts defining the ejecting mechanism 121 of the rear ejector 120 are replaced by another mechanism by which to eject the second metallic blank 200, such as, but not limited to, rollers.

In an example blanking die 100 illustrated in FIGS. 1-5, the ejecting mechanism 121 of the rear ejector 120 is driven by an electric motor 127 of the blanking die 100. The electric motor 127 drives the ejecting mechanism 121 of the rear ejector 120 to eject the second metallic blank 200 to the front ejector 130 when the ejecting mechanism 121 of the rear ejector 120 is in the ejection position. In an example, the electric motor 127 further ceases the driving of the ejecting mechanism 121 of the rear ejector 120 after the second metallic blank 200 is ejected to the front ejector 130. In another example, the electric motor 127 drives the ejecting mechanism 121 of the rear ejector 120 at all times during an operation of the blanking die 100. In an example in which the ejecting mechanism 121 of the rear ejector 120 is defined by the conveyor belts, the conveyor belts are driven by the electric motor 127.

In an example blanking die 100 illustrated in cutting stage 601 of FIG. 5, the metallic blanks 200, 300 have been formed by the two blank cutters 115, 128. In another example blanking die 100 illustrated in cutting stage 601 of FIG. 5, the sheet metal 150 has been pressed by the blanking press 140 onto the blank cutters 115, 128 in order for the sheet metal 150 to be blanked into the metallic blanks 200, 300. In an additional example, the front blank cutter 128 is positioned between the front ejector 130 and a rear ejector 120 over which the second metallic blank 200 is positioned.

According to an example blanking die 100 illustrated in ejecting stage 602 of FIG. 5, the ejecting of the metallic blanks 200, 300 in a predetermined direction respectively using the rear and front ejectors 120, 130 has commenced. In an example, the first metallic blank 300 can be ejected before the ejecting of the second metallic blank 200 to the front ejector 130. In another example, the first metallic blank 300 can be ejected during a simultaneous ejection of the second metallic blank to the front ejector 130.

According to an example blanking die 100 illustrated in ejecting stage 602 of FIG. 5, the second metallic blank 200 is in the process of being ejected in the predetermined direction to the front ejector 130 such that the front ejector 130 can further eject the second metallic blank 200 in the predetermined direction out of the blanking die 100. However, embodiments disclosed herein are not limited thereto. For example, the second metallic blank 200 can be ejected solely by the ejecting mechanism 121 of the rear ejector 120.

In another example, the ejecting mechanism 121 of the rear ejector 120 ejecting the second metallic blank 200 is movably supported with the rear ejector frame 123 and stored in a storage position within a cavity 124 of the blanking die 100. In a further example, the ejecting of the second metallic blank 200 includes a raising of the rear ejector frame 123 to move the ejecting mechanism 121 of the rear ejector 120 from the storage position to an ejection position above the cavity 124 to eject the second metallic blank 200 to the front ejector 130 and lowering the rear ejector frame 123 to move the ejecting mechanism 121 of the rear ejector 120 from the ejection position to the storage position after the second metallic blank 200 is ejected.

In an example, after the sheet metal 150 is cut to form the metallic blanks 200, 300 and prior to the ejection of the second metallic blank 200 to the first ejector 130, the second metallic blank 200 can be staged using the rear rollers 125 positioned over the storage position of the ejecting mechanism 121 and below the ejection position of the ejecting mechanism 121. In an example, the ejecting mechanism 121 of the rear ejector 120 is configured to move the resting second metallic blank 200 to the ejection position when the rear ejector frame 123 is raised.

In an example, the ejecting mechanism 121 by which the second metallic blank 200 is ejected is driven to eject the second metallic blank 200 to the front ejector 130 when the ejecting mechanism 121 of the rear ejector 120 is in the ejection position. In another example, the driving of the ejecting mechanism 121 of the rear ejector 120 ceases after the second metallic blank 200 is ejected to the front ejector 130. In a further example, the ejecting mechanism 121 of the rear ejector 120 is defined by at least one conveyor belt on which the second metallic blank 200 rests in the ejection position. In yet another example, the conveyor belt defining the ejecting mechanism 121 is configured to eject the second metallic blank 200 to the front ejector 130. When the rear ejector frame 123 is raised into the ejection position, the driving of the ejecting mechanism 121 of the rear ejector 120 can include spinning the conveyor belt defining the ejecting mechanism 121 to eject the second metallic blank 200 to the front ejector 130.

In an example, the rear ejector frame 123 is raised and lowered by a pneumatic system 122 defined by air cylinders and configured to raise and lower the rear ejector frame 123. In another example, the air cylinders are further configured to extend to raise the rear ejector frame 123 and contract to lower the rear ejector frame 123.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A blanking die, comprising:

a blanking apparatus configured to form a series of at least two metallic blanks from sheet metal fed along a first direction, wherein the blanking apparatus performs a single cutting stroke to form the series of at least two metallic blanks; and an ejection apparatus configured to eject a first one of the series of the metallic blanks out of the blanking die in a predetermined direction and a second one of the series of the metallic blanks out of the blanking die in the predetermined direction, wherein the predetermined direction and the first direction are substantially parallel; wherein the ejection apparatus comprises:

a front ejector;

a rear ejector having an ejecting mechanism and a cavity;

a rear ejector frame configured to movably support the ejecting mechanism, wherein the ejecting mechanism is stored in the cavity until the ejecting mechanism is needed, wherein when the ejecting mechanism ejects the second one of the metallic blanks in the predetermined direction, the rear ejector frame raises the ejecting mechanism from a storage position in the cavity in which the ejecting mechanism is stored to an ejection position above the cavity, wherein after the single cutting stroke, the first metallic blank is elected by the front ejector without contacting the ejecting mechanism and the second metallic blank is transported to the front ejector by the ejecting mechanism.

2. The blanking die of claim 1, wherein the front ejector is configured to eject the first one of the metallic blanks out of the blanking die in the predetermined direction, and the rear ejector is configured to transport the second one of the metallic blanks to the front ejector while the first one of the metallic blanks is being ejected by the front ejector.

3. The blanking die of claim 2, wherein the front ejector is further configured to eject the second one of the metallic blanks ejected by the rear ejector out of the blanking die in the predetermined direction.

4. The blanking die of claim 2, wherein the blanking apparatus comprises a front blank cutter and a rear blank cutter, the front blank cutter being positioned between the front ejector and the rear ejector, the front blank cutter being configured to cut the sheet metal to form the first one of the metallic blanks, the second one of the metallic blanks being formed between and by the front blank cutter and the rear blank cutter.

5. The blanking die of claim 2, wherein the ejecting mechanism is configured to eject the second one of the metallic blanks to the front ejector in the predetermined direction, wherein the ejecting mechanism is stored until the ejecting mechanism is needed to eject the second one of the metallic blanks to the front ejector.

6. The blanking die of claim 5, wherein the ejecting mechanism is defined by at least one conveyor belt ejecting the second one of the metallic blanks of the series to the front ejector in the predetermined direction.

7. The blanking die of claim 5, wherein, when the ejecting mechanism is needed to eject the second one of the metallic blanks in the predetermined direction to the front ejector, the rear ejector frame raises the ejecting mechanism from a storage position in the cavity in which the ejecting mechanism is stored to an ejection position above the cavity, and wherein, when the ejecting mechanism has ejected the second one of the metallic blanks to the front ejector, the rear ejector frame lowers the ejecting mechanism from the ejection position to the storage position.

8. The blanking die of claim 7, further comprising:

a pneumatic system configured to raise the rear ejector frame from the storage position in the cavity to the ejection position above the cavity when the ejecting mechanism is needed to eject the second one of the metallic blanks to the front ejector and lower the rear ejector frame from the ejection position to the storage position when the ejecting mechanism has ejected the second one of the metallic blanks to the front ejector.

9. The blanking die of claim 8, wherein the pneumatic system is defined as one or more air cylinders configured to raise and lower the rear ejector frame by respectively extending and contracting.

10. The blanking die of claim 5, wherein the rear ejector further comprises a staging mechanism by which support is provided for the second one of the metallic blanks after the second one of the metallic blanks is formed and prior to the ejection of the second one of the metallic blanks to the front ejector by the ejecting mechanism.

11. A blanking die, comprising:

a blanking apparatus configured to form, from sheet metal fed along a first direction, a series of at least two metallic blanks, wherein the blanking apparatus performs a single cutting stroke to form the series of at least two metallic blanks;

an ejection apparatus configured to eject a first one of the metallic blanks out of the blanking die in a predetermined direction and a second one of the metallic blanks out of the blanking die in the predetermined direction, wherein the first direction and the predetermined direction are substantially parallel, the ejection apparatus comprising a front ejector and a rear ejector, the front ejector being configured to eject the first one of the metallic blanks out of the blanking die, the rear ejector comprising an ejecting mechanism and a cavity, the ejecting mechanism being configured to eject the second one of the metallic blanks in the predetermined direction to the front ejector while the first one of the metallic blanks is being ejected by the front ejector, the front ejector being further configured to eject the second one of the metallic blanks ejected by the ejecting mechanism out of the blanking die in the predetermined direction, the cavity being configured to store the ejecting mechanism in a storage position within the cavity until the ejecting mechanism is needed in an ejection position above the cavity to eject the second one of the metallic blanks to the front ejector; and a pneumatic system configured to raise the ejecting mechanism from the storage position to the ejection position when the ejecting mechanism is needed to eject the second one of the metallic blanks to the front ejector and lower the ejecting mechanism from the ejection position to the storage position when the ejecting mechanism has ejected the second one of the metallic blanks to the front ejector, wherein after the single cutting stroke, the first metallic blank is ejected by the front ejector without contacting the ejecting mechanism and the second metallic blank is transported to the front ejector by the ejecting mechanism.

12. The blanking die of claim 11, further comprising:

a rear ejector frame configured to movably support the ejecting mechanism, wherein the pneumatic system raises the rear ejector frame to raise the ejecting mechanism from the storage position to the ejection position when the ejecting mechanism is needed to eject the second one of the metallic blanks to the front ejector in the predetermined direction and lowers the rear ejector frame to lower the ejecting mechanism from the ejection position to the storage position when the ejecting mechanism has ejected the second one of the metallic blanks to the front ejector.

* * * * *